United States Patent [19]

Norena

[11] Patent Number: 4,846,093

[45] Date of Patent: Jul. 11, 1989

[54] SYSTEM FOR RELEASING AN ANCHOR MOORED TO THE BOTTOM OF THE SEA

[76] Inventor: Alfonso G. Norena, P° Rosales, 36 - 8°izda. - Escla. dcha., 28008 Madrid, Spain

[21] Appl. No.: 64,196

[22] Filed: Jun. 18, 1987

[30] Foreign Application Priority Data

Jun. 25, 1986 [ES] Spain ..... 556783
Jan. 21, 1987 [ES] Spain ..... 557345

[51] Int. Cl.[4] ..... B63B 21/22

[52] U.S. Cl. ..... 114/294; 114/221 R; 114/297

[58] Field of Search ..... 114/210, 297, 221 R, 114/221 A, 293, 298, 299; 24/241 PS, 232 R, 232 G, 598, 652, 653, 656; 294/66.1, 82.24, 82.27, 82.34, 82.31

[56] References Cited

U.S. PATENT DOCUMENTS 3,809,001 5/1974 Shute ..... 294/66.1
4,724,789 2/1988 Van Den Haak ..... 114/293

FOREIGN PATENT DOCUMENTS 0206530 12/1986 European Pat. Off. ..... 114/297

*Primary Examiner*—Joseph F. Peters, Jr.
*Assistant Examiner*—Edwin L. Swinehart
*Attorney, Agent, or Firm*—Ladas & Parry

[57] ABSTRACT

A system for releasing an anchor moored to the bottom of the sea, based on a mechanical device being inserted between the lower end of the anchor suspension chain or cable and the upper part of the arm of the anchor. The mechanical device basically comprises two in-between articulated parts, which, in their normal position, are blocked in order to form a single body for attaching the above-mentioned lower end of the anchor suspension cable to the upper end of the anchor arm. Through the use of an additional and independent accessory or piece which is made to slide along the very anchor suspension cable, both parts of the device are unblocked, by tractioning said additional and independent piece. The unblocking implies that one the parts of the device will be only attached to the lower end of the suspension cable, while the other part will be attached to the upper end of the anchor arm, all that so that the tractioning force for raising the anchor will be exerted from the lower part thereof, i.e., in a sense practically opposite to the axle of the plane formed by the claws or bills of the anchor. The way of tractioning the anchor is achieved by virtue of the fact that between the lower base of the anchor and the part being attached when unblocking to the lower end of the suspension cable, a small chain is fixed.

14 Claims, 15 Drawing Sheets

SYSTEM FOR RELEASING AN ANCHOR MOORED TO THE BOTTOM OF THE SEA

Figure 1:
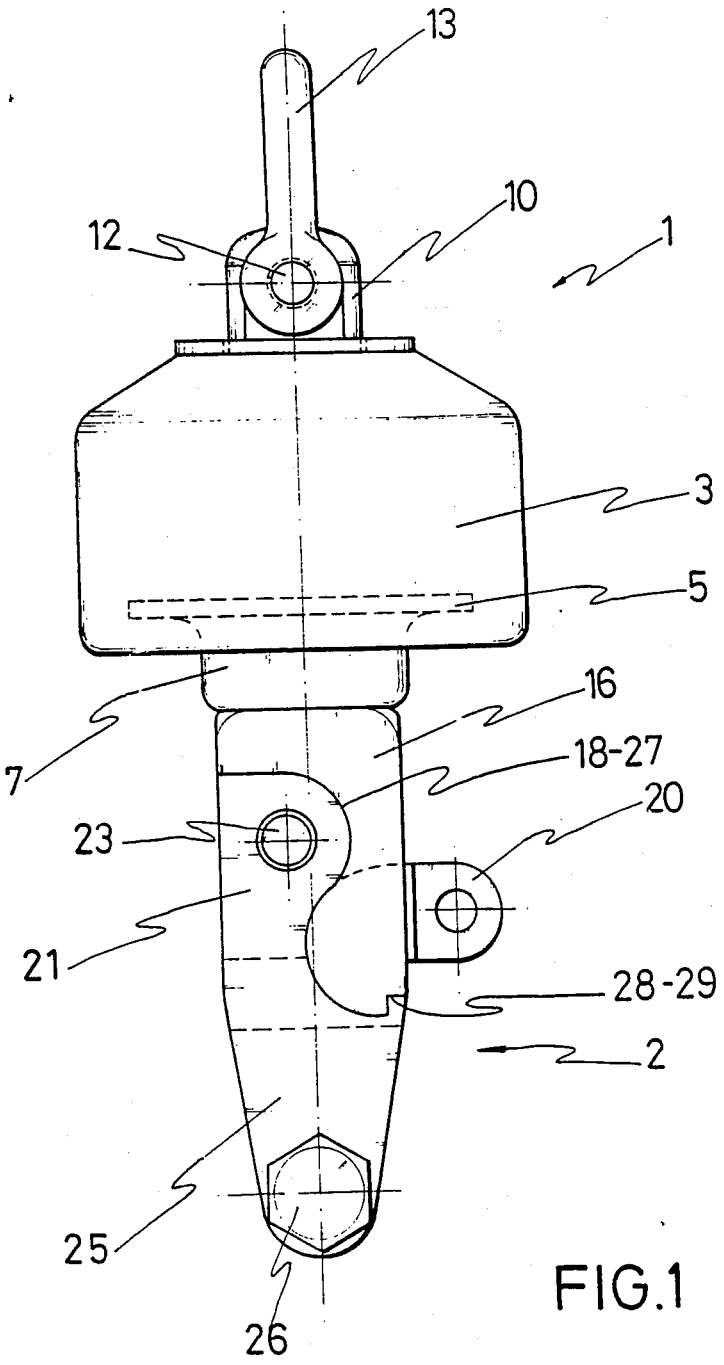

The invention refers to a system for releasing an anchor moored to the bottom of the sea, being based on inserting between the end of the anchor-suspension chain or cable and the upper portion thereof means through which, when tractioning by an accessory, said chain or cable becomes free from the upper end of the anchor arm, but said chain or cable standing attached to the base of the anchor, so that the traction force is exerted practically in an opposite sense with respect to the axle of the plane formed by the claws or bills of said anchor, thereby enabling the latter to come out of the obstacle wherein it had been retained.

The system according to the invention is foreseen for its use, preferably, in small and medium-sized boats and, specially, in sports boats, constituting a quite efficient means for the purpose for which it has been conceived. Nor can its use in bigger boats be discarded, in which case the means constituting the system will be constructed on a larger scale.

It is widely known that, when the boats or vessels are anchored, the corresponding anchors are very often retained in obstacles or cracks of the sea bottom, it being impossible to release them, since one always tractions on the upper end of the anchor arm through the corresponding suspension chain or cable thereof, so that, as a consequence of this way of tractioning, the only thing one gets sometimes is mooring the anchor more and more into the crack wherein it is retained. In such cases in which the anchor is moored to the sea bottom, it is necessary to go down up to said bottom and release the anchor manually, which is not always possible and represents a disadvantage at the same time as a loss of time and an actual danger, all which may force to abandon it.

The system proposed by the invention has been conceived for avoiding said kind of troubles and disadvantages, thereby achieving an easy releasing of the anchor, although this one is moored in the aforementioned way. Said releasing by means of the system according to the invention is made through the anchor base and not through the upper end, so that said traction will be performed practically in an opposite sense with respect to the axle of the plane formed by the claws or bills, thereby enabling the anchor to come out of the obstacle wherein it had been retained.

The system in question may be said to constitute a device comprising two parts which may become independent in-between, one of which is attached to the suspension element and, in its turn, joined through a little chain to the anchor base, whilst the other part is attached to the very upper end of the anchor arm, all that so that, when both pieces become independent in-between, the traction will be made from the anchor base.

Therefore, the device constituting the system has been foreseen for being inserted between the upper end of the anchor arm and the corresponding suspension element.

The first part of the device, that is to say, that one which is suspended from the end of the chain or cable, is constituted from some kind of inverted housing inside which a disk piece with a central and concentric hole that extends outwardly into a cylindrical neck is located, so that, through this disk piece a bolt is made to pass, the upper end of which emerges out of the housing-shaped piece so that at said end a shackle or similar element is arranged, thereby being able to join this piece or part assembly to the end of the already mentioned chain or cable.

An expansion spring is arranged between the bottom of the housing-shaped piece and the inner face of the disk piece, said expansion spring pushing such a disk piece outwards, the latter making buffer by the outer edge of its neck against an expansion of the very bolt, said expansion adopting a forked shape, the branches thereof being provided with additional projections and recesses, so that, between said branched expansion branches a ramp forming part of the very end of the above mentioned bolt is defined, at the beginning thereof, the configuration of said forked expansion being complementary to the second part or piece which may become independent, the latter having a shape that may be consider as prismatic. At the end at which said piece becomes coupled or associated with the forked expansion, a pawl mounted on a rotation axle has been foreseen, whilst at the opposite end of said piece that may become independent there is a transversal pin for assembling the set at the upper end of the anchor arm.

The above mentioned pawl has an inclined edge that is complementary to the inclined ramp into which the above mentioned bolt end finishes, so that the end of said pawl adopts a nail-shaped configuration arched by the part being opposite to that of the bevelled plane, in order to enable the partial insertion thereof into the inside of the cylindrical neck of the disk piece, all that in order to carry out thus the fixing between both pieces or parts, that is to say, between the piece or part that may become independent and the forked expansion of the bolt, until, by tractioning upwards the disk piece that presses the spring, it becomes free from said pawl and the second piece which is attached to the upper end of the anchor arm becomes independent.

The tractioning of the disk piece in order to make the piece or part being attached to the chain or cable for the suspension of the assembly independent, is carried out by means of an accessory formed by some kind of cylindrical cage that runs through the very suspension chain or cable, so that this cage-shaped accessory finishes by its lower end into a projection that determines a means which is adjusted to the lower face of the very disk piece, so that, when tractioning the former, by means of a cable or the like tied thereto, one tractions upwards on the very disk piece and, consequently, the pawl is released, the piece on which the pawl is arranged becoming thus independent with respect to the upper piece, both parts or pieces of the device being therefore separated.

The operation to be carried out for the anchor to be released from the anchoring which may have been made in a crack or obstacle is performed in two stages: firstly, the boat will be driven until it is positioned over a zone near the vertical of the anchor, letting said attachment and tractioning accessory fall along said mooring element, until one can realize by a slight pull that the device has functioned, that is to say, that both parts or pieces constituting it have become free from each other. At the second stage, the boat will be advanced in the opposite direction to that one in which it had been anchored, up to a distance similar to that one that there was from the anchored anchor up to said boat, pulling afterwards the anchor suspension cable or chain, which, as the force is exerted, such as it has already been indicated, at the lower part or base thereof, will take it out easily from the place wherein it was retained, being then lift up on board as usually and mounting the device again before proceeding to put it away.

In a second way of preferable embodiment, the device displays the peculiarity that the hole provided at the piece constituting the housing and, in correspondencen with the upper portion thereof, has at its surroundings and affecting the very base of the housing two pairs of cuts or cavities performed perpendicularly in-between, the cuts of one pair being larger with respect to the amplitude of the cuts of the other pair. By means of this novelty, it is possible to mount whichever size of shackle for joining the suspension chain or cable to the device.

In this second way of embodiment it has also been foreseen that the pawl by which the release and/or anchoring of both basic pieces or parts of the device was attained, forms an unseparable part of the piece that is attached to the upper end of the anchor arm, thereby forming a single body with said piece that may become independent.

In this case there will be no need of a rotation axle for said pawl, since, as it has just been said, this one forms part of the piece that may become independent, giving thus a greater strength to the assembly of the device and avoiding manufacture costs.

It has also been foreseen in this second way of embodiment of the invention that the additional recesses and projections provided at the two pieces constituting the device are fully straight, in order to favour the mechanization of such pieces.

It is also an object of this second of embodiment that the accessory constituting the cage-like structure for making both pieces of the device independent from each other, is preferably formed by two rods which are bent at their lower portion and joined with no break in continuity by an also bent portion that will be the one being inserted under the housing-shaped piece for tractioning the disk that keeps both pieces of the device retained in mounting position, both turns being arranged between said two rods of the accessory or cage, one of them in correspondence with the upper part or end and the other near the lower part, through which turns the passage of the suspension chain or cable can be directly made with no need to insert it through one of the ends thereof.

In a third variant of embodiment, the device is constituted in such a way that the two pieces that may become independent from each other are articulated in-between through a pin, so that said pieces will never be independent from each other, but they will always be joined through said articulation pin, but with the possibility that the lower piece may be released from the disk located inside the housing-shaped piece, so that, when said disk is released, the lower piece will seesaw, thereby achieving the release of the upper end of the anchor arm, which in this case will be located in a passage defined between both pieces when the lower or seesawing piece is retained by said disk, or, for better saying, by the neck into which said disk extends and which is located, as it has already been said, inside the housing-shaped piece.

This third way of embodiment determines the device to be simpler as far as the manufacture of the two basic pieces thereof is concerned.

On the other hand, the accessory constituting the cylindrical cage-like structure for making both device pieces or parts independent, can be constituted by two parallel rods, which by one of their ends are bent and joined in-between through an arched trapezoidal portion in order to determine the adjustment means on the lower face of the very disk piece and perform the corresponding tractioning upwards; having also been foreseen that the upper and lower rings or turns may be divided into two halves, one of them being hinged in order to allow the easy opening and manual closure thereof and insert then comfortably the anchor suspension chain or cable, said rings or turns being able, too, to be open, i.e., to lack a portion which will be materialized by a band or the like that, by its deformation, allowed the insertion of said anchor suspension chain or cable, so that said band or the like returns then to its original position closing said open part or portion of each ring or turn, thereby preventing said anchor suspension chain or cable from going out.

On the grounds of the attached drawings, which form a part of the present specification, the characteristics of the device constituting the system according to the invention will be more clearly understood. In said drawings, the following has been represented:

FIG. 1: It shows a lateral elevational view of the device according to the invention.

Figure 2:
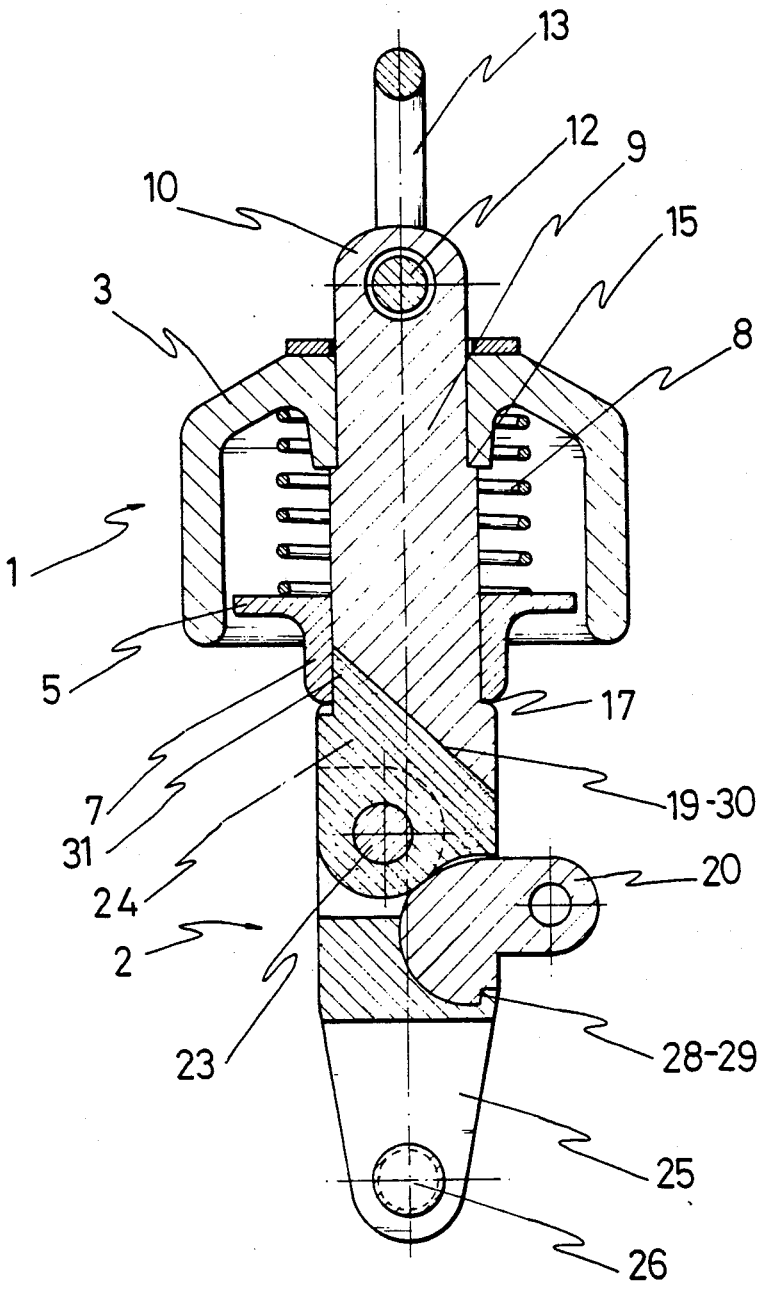

FIG. 2: It shows a longitudinally sectioned view of the device as represented in the above figure, wherein the different parts and elements thereof can be clearly seen.

Figure 3:
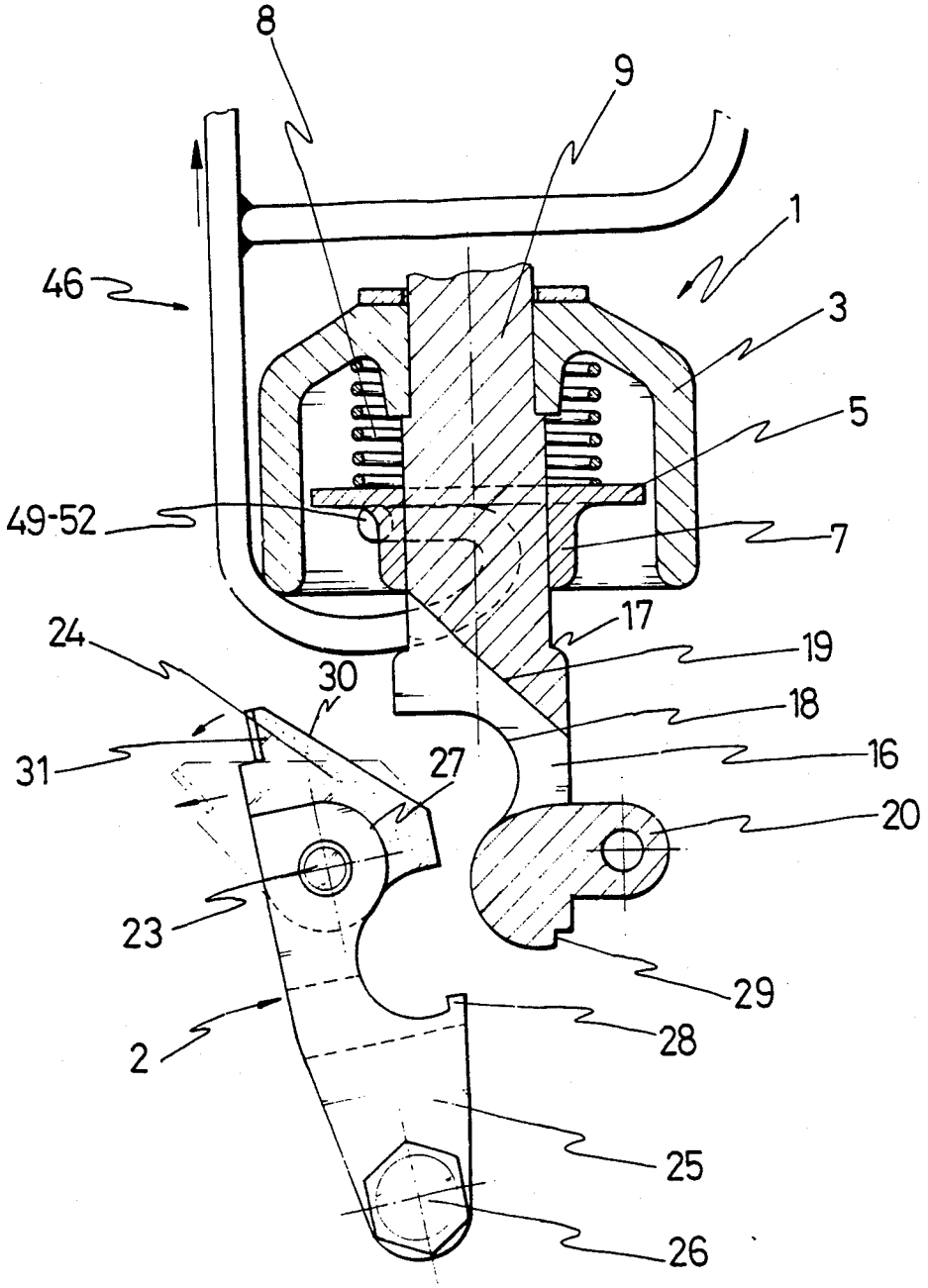

FIG. 3: It shows another sectioned view of the same device with the two basic pieces or parts independent from each other as a consequence of the upward tractioning exerted by the cage-like accessory on the disk located inside the housing-shaped piece.

Figure 4:
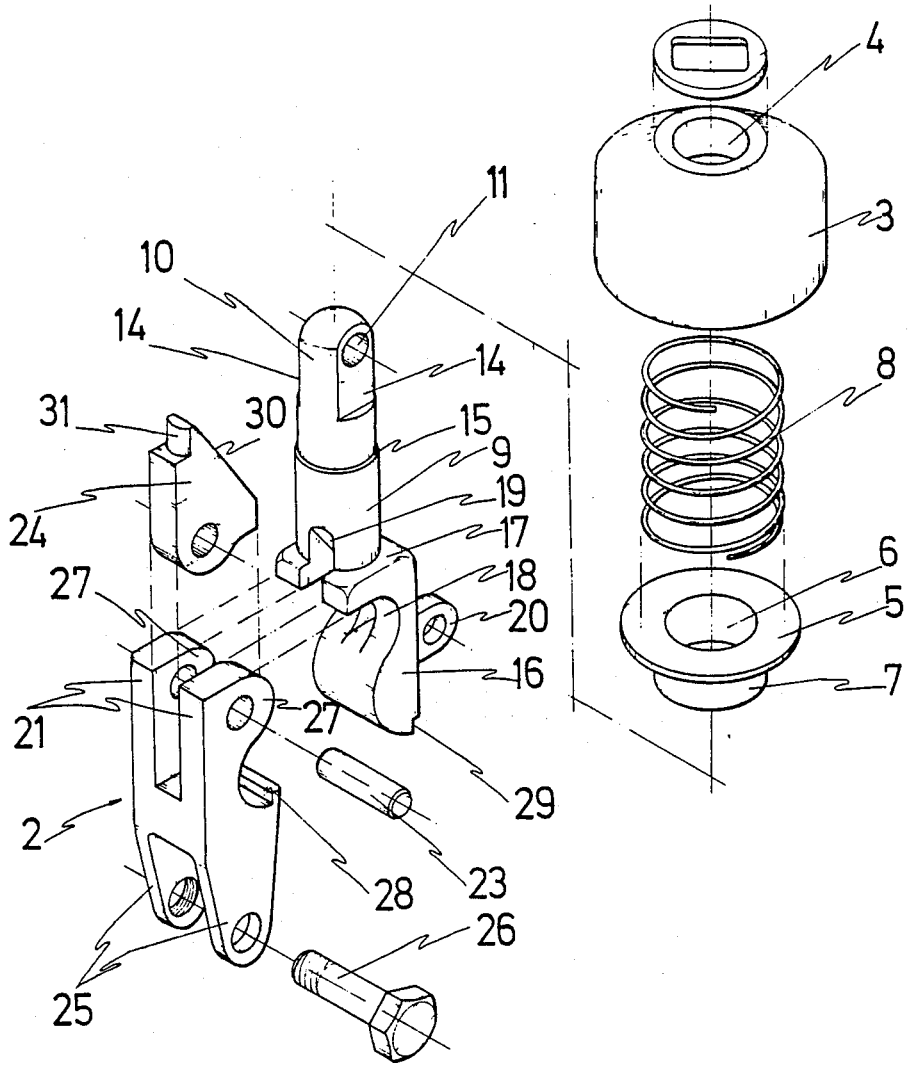

FIG. 4: It shows a view in perspective and of the different pieces and elements constituting the device assembly, in the position to be mounted for constituting the device as represented in FIG. 1.

Figure 5:
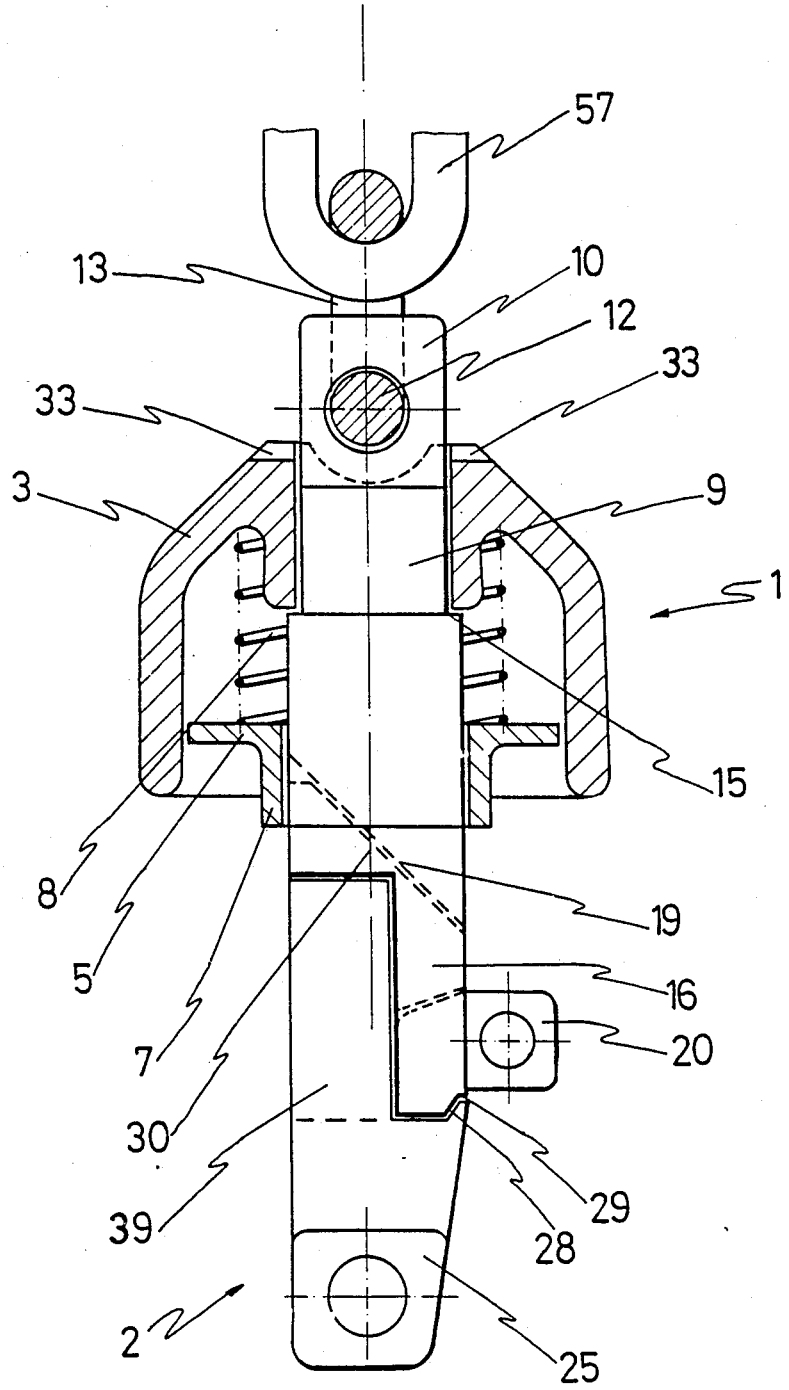

FIG. 5: It shows an elevational view of the device in a second way of embodiment, said sectional view showing the housing-shaped piece and the disk located thereinside.

Figure 6:
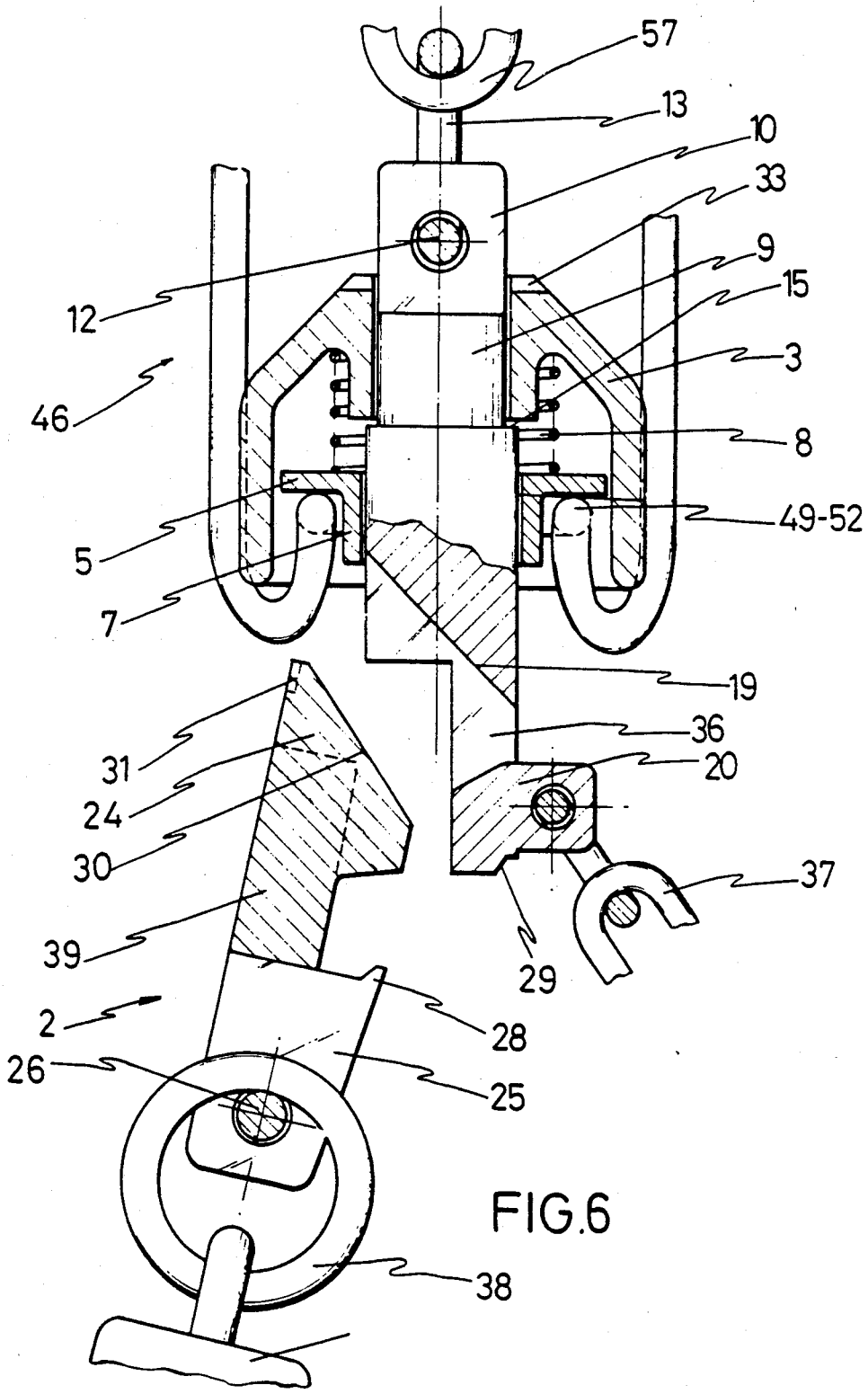

FIG. 6: It shows another elevational view, an also sectional one, of the device as represented in the previous figure, but the two main pieces or parts being independent from each other when tractioning upwards the disk located in the housing, by means of the cage-shaped accessory.

Figure 7:
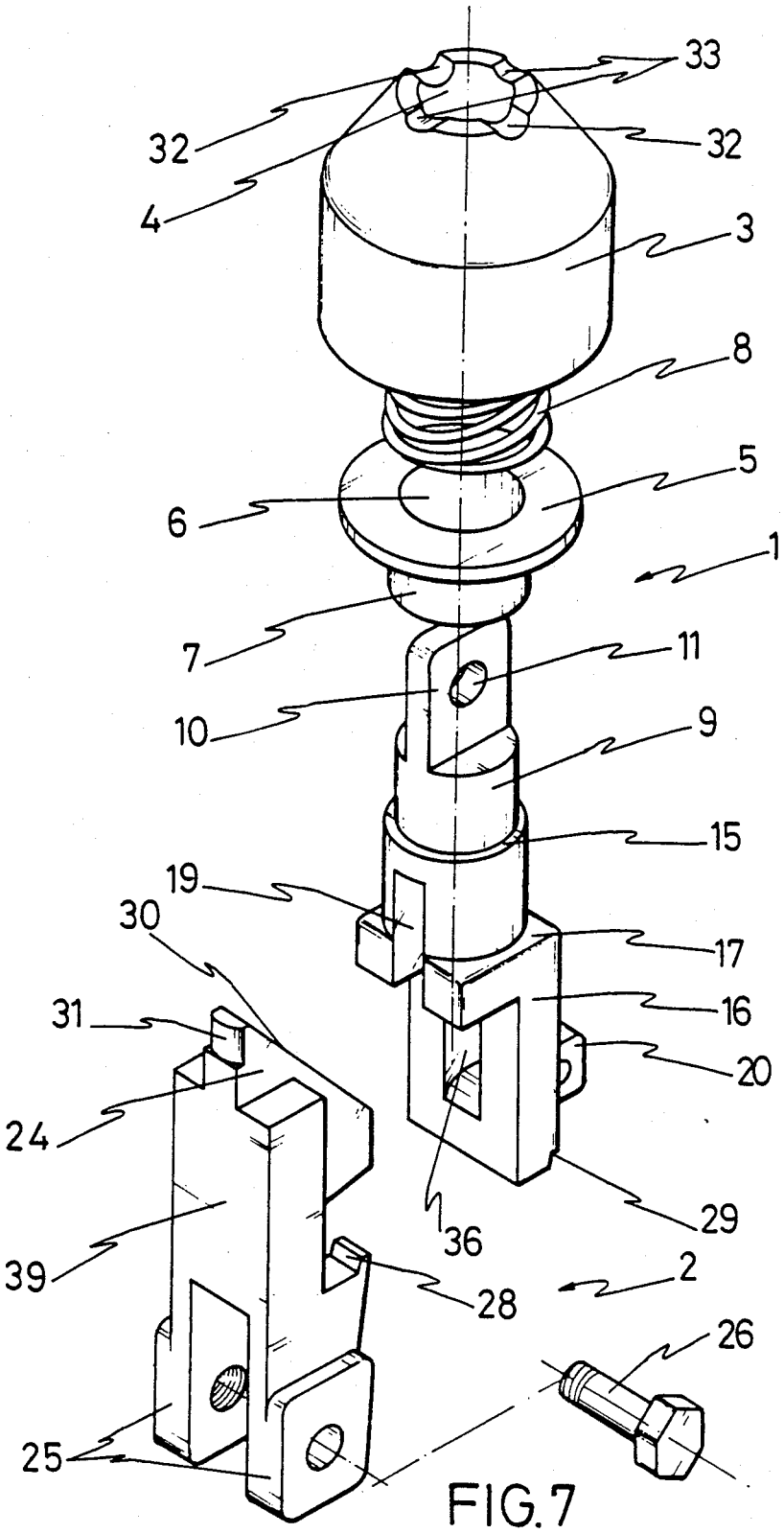

FIG. 7: It shows a view in perspective and of the different elements of the device as shown in the previous figures.

Figure 8:
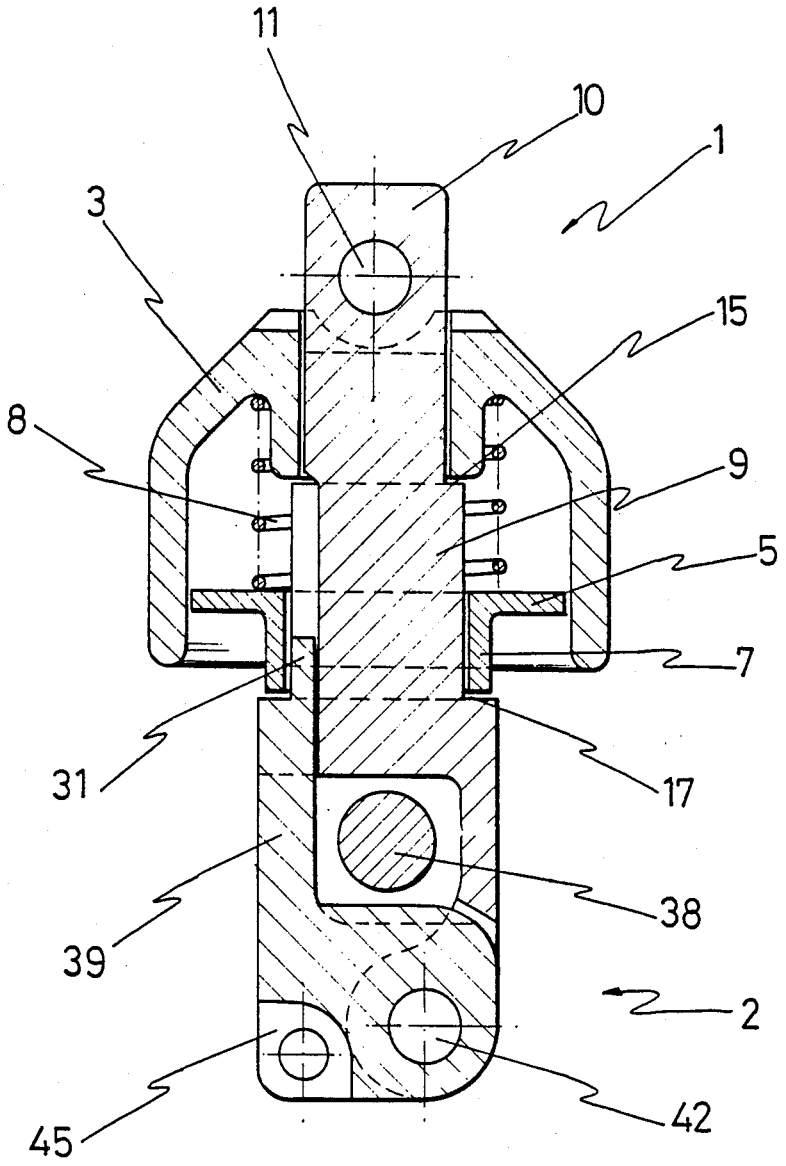

FIG. 8: It shows a longitudinally sectional view of the device corresponding to the third way of embodiment.

Figure 9:
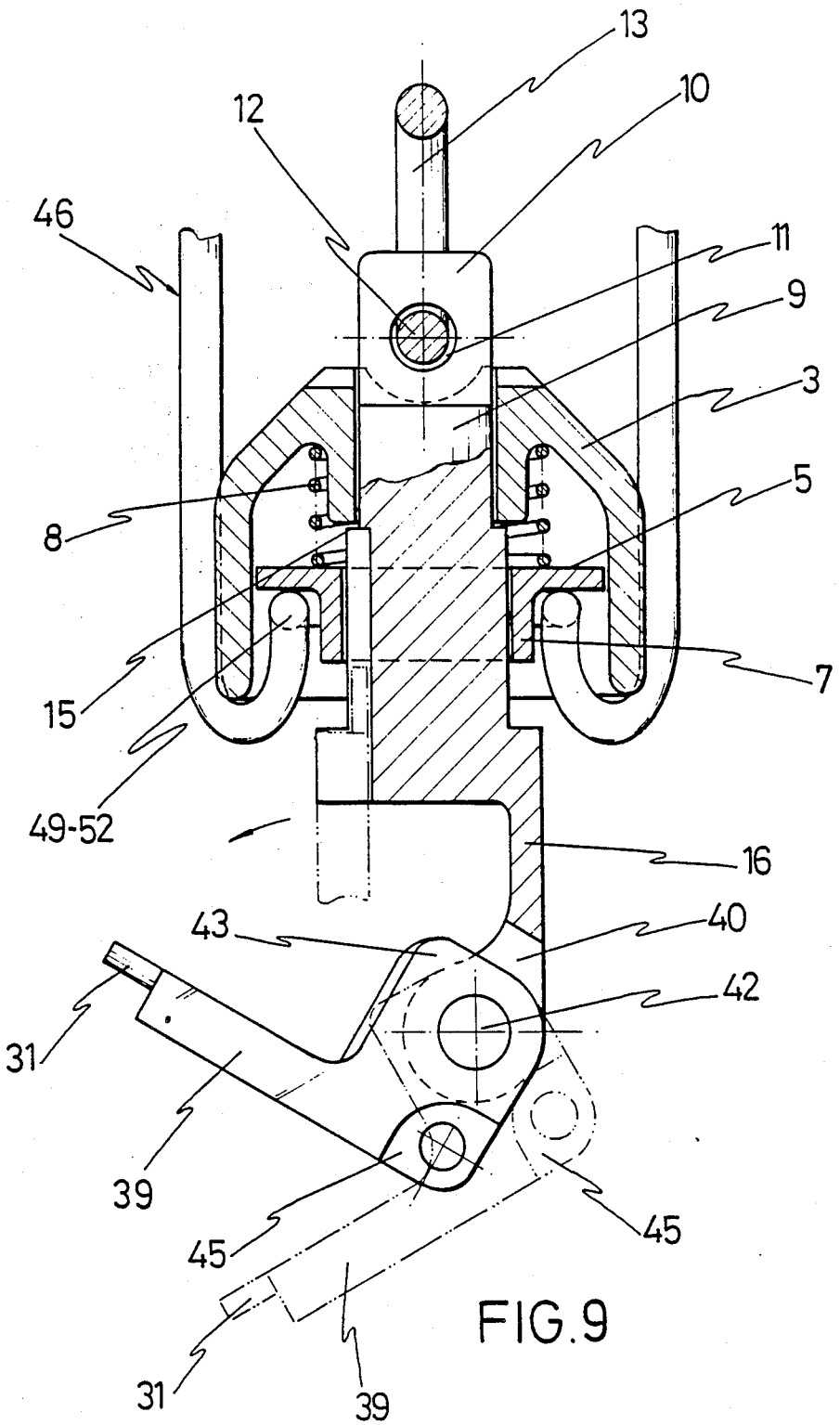

FIG. 9: It shows an also sectional view of the device as represented in the above figure with one of the pieces in an unblocking position with respect to the other as a consequence of the tractioning exerted upwards on the disk located in the housing, which tractioning is carried out by means of the cage-shaped accessory.

Figure 10:
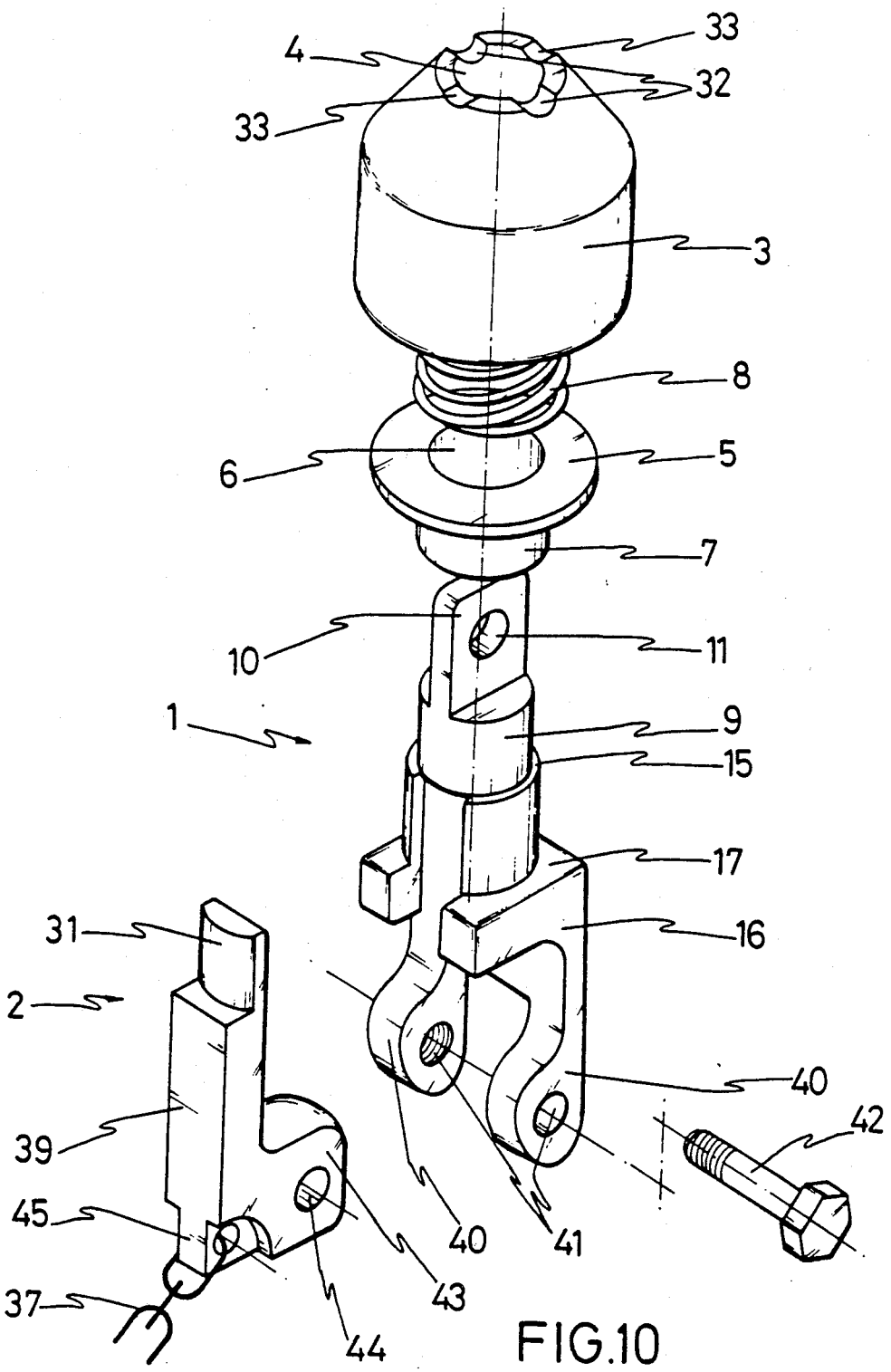

FIG. 10: It shows a view in perspective and of the different elements of the device as represented in the two previous figures.

Figure 11:
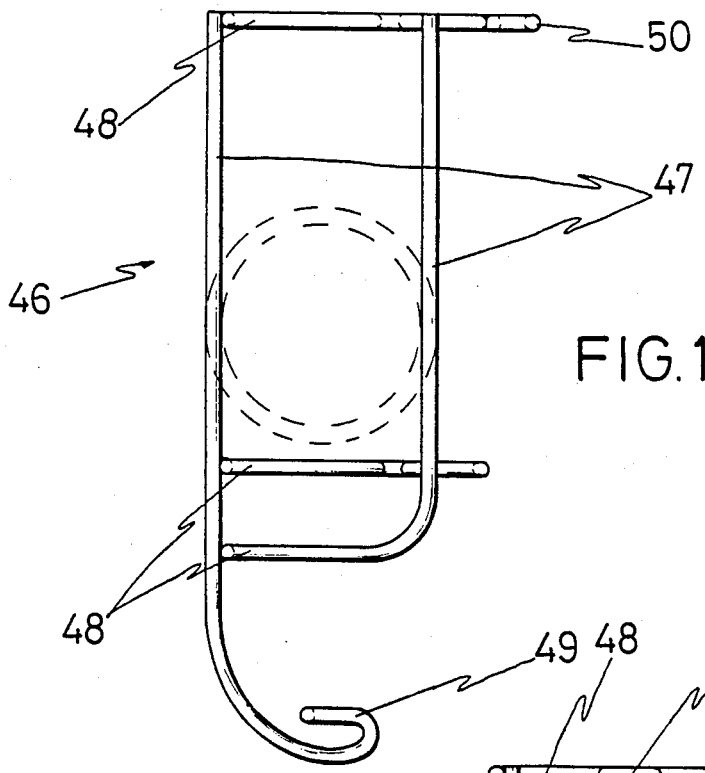

FIG. 11: It shows a lateral elevational view of the cage-shaped accessory by means of which the tractioning of the device is carried out in order to make the two basic pieces thereof independent. In this figure, a circular intermediate contour has been represented in a dotted line, indicating that said accessory is cylindrical.

Figure 12:
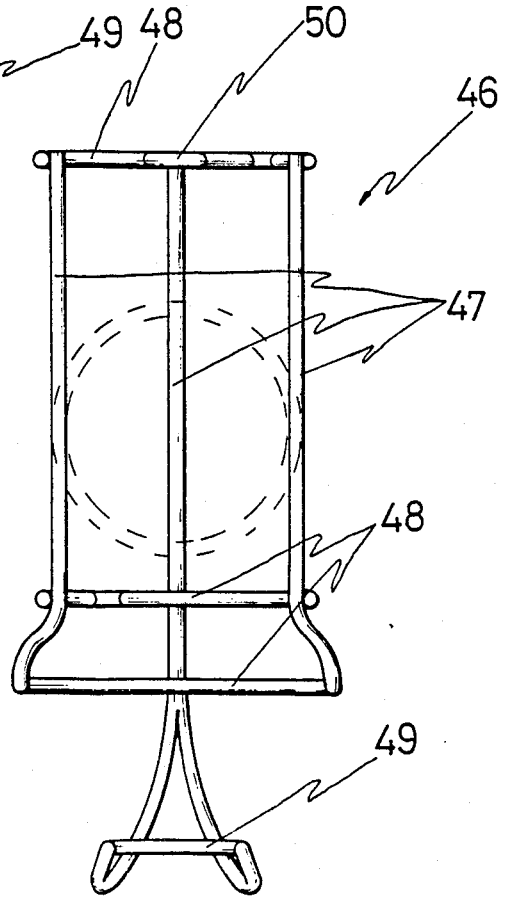

FIG. 12: It shows another view of the same accessory as represented in FIG. 11.

Figure 13:
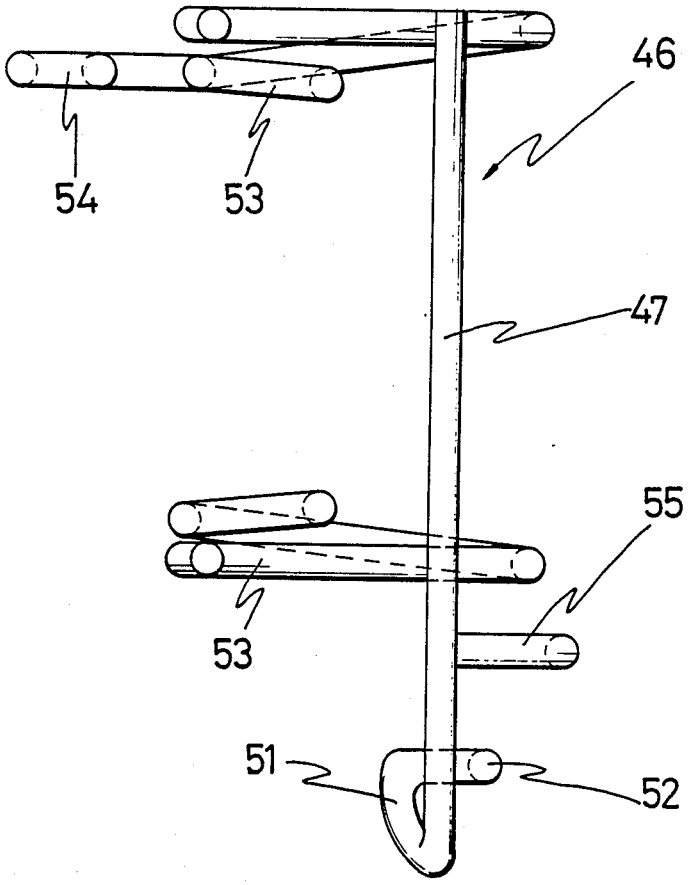

FIG. 13: It shows the cage-shaped accessory in a preferable embodiment thereof.

Figure 14:
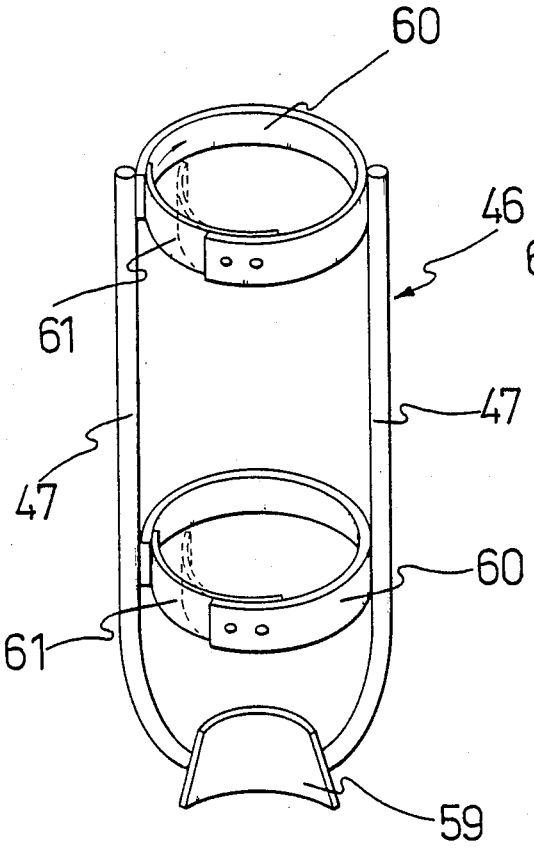

FIG. 14: It shows a view in perspective of the tractioning accessory in a different way of embodiment, wherein the upper or lower rings or turns are open and there is a band or the like in correspondence with the very open portions.

Figure 15:
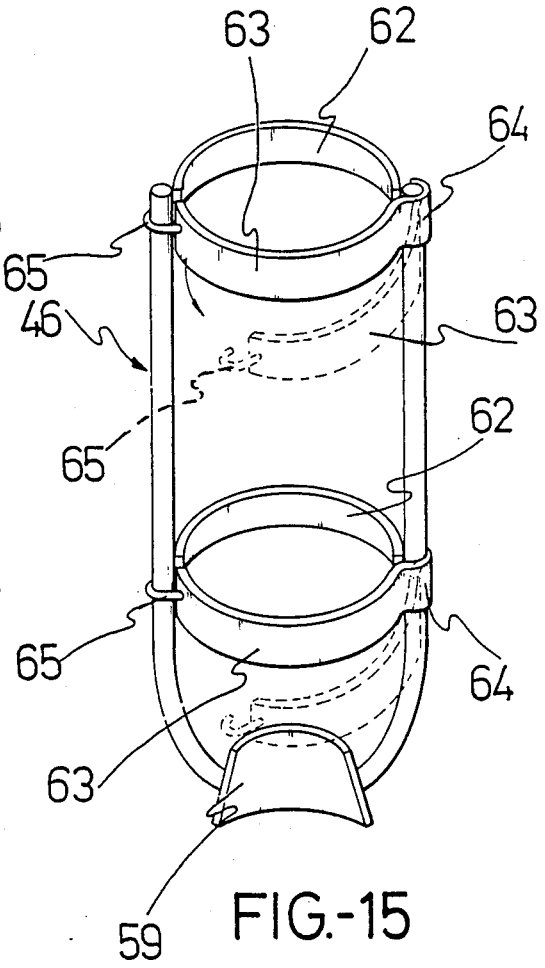

FIG. 15: It shows a view in perspective of the accessory as shown in the previous figure, wherein each half of each ring or turn is hinged.

Figure 16:
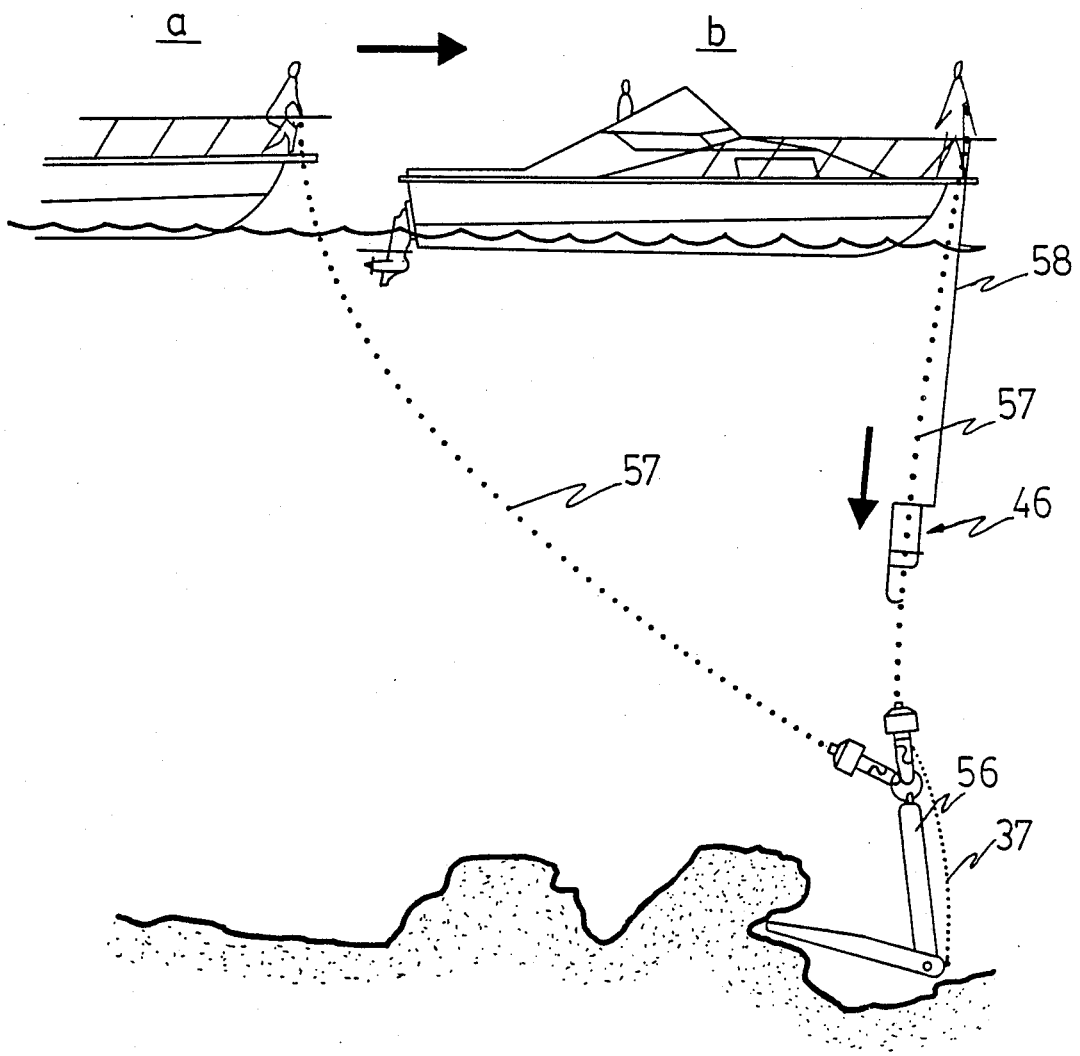
Figure 17:
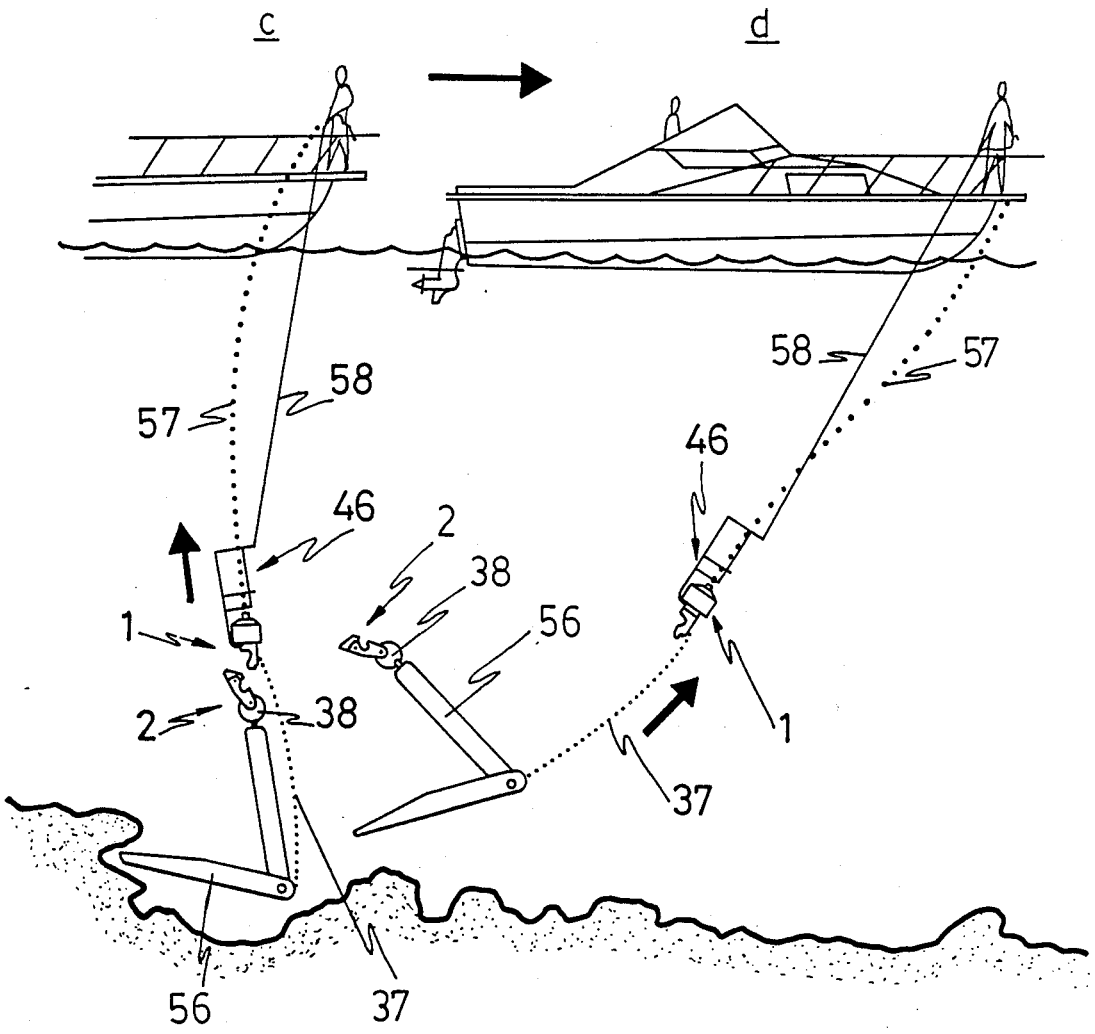

Finally, FIGS. 16 and 17 show corresponding schematic views of the way how to drive a boat in order to release the anchor being moored to the bottom of the sea, by means of the device according to the invention.

According to the above described figures, FIGS. 1 to 4 show the device in its first way of embodiment, being basically constituted by two parts which may become independent from each other and which are generally referred to with numbers 1 and 2.

Part 1 comprises a piece in way of an inverted housing 3 with a hole 4 in its base. Inside said housing-shaped piece 3 there is a disk piece 5 affected with a concentric hole 6 and extending into a cylindrical neck 7, an expansion spring 8 being located between the bottom of the housing 3 and the upper surface of the disk piece 5, such as it can be clearly seen in FIG. 2.

The three above described FIGS. 3, 5 and 8 are crossed by an axial bolt 9 that emerges by its upper end through the hole 4 of the housing 3, thereby defining an outer portion 10 of said bolt 9. The emerging portion 10 is affected with a transversal hole 11 wherein a pin 12 is located, said pin 12 for the retention of a shackle 13 or the like, so that, through said shackle 13 the device is fastened to the anchor suspension chain of cable, as it will be commented hereinafter.

The bolt 9 is provided with lateral facets 14 under which there is a step 15 defining a bigger diameter in order to constitute a buffer against the bottom of the housing 3, such as it can be seen in FIGS. 2 and 3. The lower end of of said bolt 9 extends into an expansion 16 which may be considered as having a forked shape, said forked expansion 16 fining a projecting upper portion 17 whereagainst the lower edge of the cylindrical neck 7 of the disk piece 5 just makes a buffer, thereby avoiding that the push of the spring 8 makes such a disk piece 5 go out with respect to the housing 3.

Said forked expansion 16 is laterally wave-shaped, such as it can be seen in FIG. 4, which may obviously be stepped or of any other adequate pattern, defining in any case a recess 18 from which an inclined ramp 19 is determined in an upward sense towards the bolt 9, said ramp 19 being located between the two branches configurating the forked expansion 16.

Said forked expansion 16, in the face opposite to the one that defines the wavy pattern 18, is provided with a lug 20 affected of a hole, wherein the end of a small chain will be fixed, whilst its other end will be fixed to the lower part or base of the corresponding anchor, as it will be proved hereinafter.

The other basic part of the device, considered as able to be independent and referred to in general with number 2, will be arranged just on the forked expansion 16 as mentioned. Therefor, this part 2 which can become independent, is provided with two parallel wings 21 affected of respective facing holes, wherein a pin 23 constituting a rotation axle for a pawl 24 is retained. Opposite to said wings 21 of the piece or part 2 which may become independent, this one has another two end or lower wings 25 affected of passing holes too, one of them being threaded, such as it can be seen in FIG. 4, for the fixing of a screw 26 that constitutes the means for fixing this part or piece which may become independent 2 to the upper end of the anchor arm.

The wings 21 of said part 2 which is being described, have a projecting wavy portion 27 which is adapted over the entering undulation 18 of the forked expansion 16, the means for the positioning and adjustment of both parts or pieces in-between being thus constituted.

In order to carry out the mounting of said pieces or parts, it is necessary to initiate the coupling through a projection 28 provided at the part or piece 2, which projection 28 is positioned at a step 29 provided for this effect at the lower end of the forked expansion 16.

In this way, once said projection 28 has been positioned in the step 29, it will proceed to seesaw the piece or part 2 until it coincides perfectly with the forked expansion 16, all that so that the pawl 24 is firstly adjusted in the inclined ramp 19 being determined at the forked expansion 16 and affecting the lower part of the very stem 9. The adjustment of the pawl in said ramp 19 is achieved as a consequence of the fact that the former has an inclined flat surface 30, logically facing said ramp 19. Said pawl 24 finishes at the upper portion into some kind of lug 31 with arched outer surface in order to be perfectly adapted to the corresponding zone of the stem 9, forming lateral surface with the latter when both pieces are in-between coupled, all that with previous upward traction on the disk piece 5 in order to allow the positioning of said pawl 24, so that, when said disk piece 5 is no longer tractioned, the expansion force of the spring 8 will push the former downwards untill the lower edge of the cylindrical neck 7 makes buffer against the projecting part 17 of the forked expansion 16, in which case said lug 31 of the pawl 24 will be located inside the cylindrical neck 10 and consequently retained in this position, both general pieces or parts 1 and 2 being thus fixed and retained in-between.

FIGS. 5,6 and 7 show a modification of the device defining a second embodiment thereof, said modification affecting the basic parts 1 and 2 of the assembly and the upper part of the housing-shaped piece 3.

In this sense, in said FIGS. 5, 6 and 7 it can be seen how said housing 3 is provided around the hole 4 of its base two pairs of concave cuts 32 and 33, perpendicular in-between, cuts 32 being of a bigger amplitude than cuts 33. Said cuts have been performed so that any size of shackle 13 can be used, through which shackle 13 the device assembly is joined to the corresponding suspension chain or cable 57, so that, when said shackle 13 is of a big size, its concave lower part will be adapted to the larger cuts 32, whilst when the shackle is smaller in size, said lower and concave part will be adapted to the smaller cuts 33.

As far as the stem 9 of this second way of embodiment of the device is concerned, it has the peculiarity that its lower expansion 16 lacks the curve recesses and projections mentioned in the previous embodiment, determining in this case a prismatic part, also forked, with the same ramp 19 that also affects the lower part of the very stem 9, the lug 20, provided for the same purpose, emerging from the rear part, so that, between said lug and the own beginning of the ramp 19, an opening 36 is defined.

Concerning said lug 20, this one has been foreseen for constituting the means for fixing one of the ends of the small chain 37, which will be fixed to the base of the anchor by its other end.

In this way of embodiment shown in FIGS. 5, 6 and 7, and related to the part 2 which may be become independent, it also has the lower wings 25 with the facing transversal holes for fixing the screw 26, through which the apparatus assembly will be joined to the corresponding anchor through a ring 38 or the like, such as it can be seen in FIG. 6.

The piece constituting said part 2 which may become independent, has the peculiarity that the pawl 24 is materialized in it, being provided with its corresponding lug 31 and with its inclined plane 30 for the adaptation thereof to the inclined ramp 19 of the expansion 16 corresponding to the stem 9. That is to say, in this case the coupling of both parts is carried out just in the same way, but with the peculiarity that the coupling parts are constituted by prismatic pieces, the contact surfaces of which, according to an elevational view, are straight, said prismatic pieces having an easier mechanization, with the peculiarity too that the pawl 24 is not constituted by an independent and seesawing element, but it is materialized in the very piece 39 constituting the very part 2 which may become independent.

The function of the device having been described and corresponding to this second way of embodiment shown in FIGS. 5, 6 and 7, is just the same as that foreseen for the device corresponding to the first embodiment, i.e., that one shown in FIGS. 1 to 4.

On the other hand, FIGS. 8, 9 and 10 show the device in an embodiment variant, all the parts and elements it comprises remaining constant, but with the peculiarity that in this case the piece that may become independent is articulated to the expansion of the bolt belonging to the part referred to in general with number 1. In this sense, the expansion 16 corresponding to this part 1 of the device lacks the inclined ramp, there being, defined in it, two parallel and lower arms 40 affected of respective passing holes 41 for the passing and fixing of a screw 42 that constitutes the articulation and seesawing axle of the piece 39 constituting the general part 2 of the device, for which this piece 39 also lacks the inclined ramp or plane and of course the pawl, only and exclusively determining the upper lug 31, as well as, at the lower part, a projecting part 43 affected of a hole 44, which hole faces holes 41 in the positioning thereof between the arms 40, in order to make thus pass the screw 42 through said three holes 41 and 44 and constitute the articulation means between both parts or pieces, with which the piece 39 will not become free in this case from the general part 1, but, when driving the device, it will seesaw in order to separate in-between only and exclusively the suspension chain or cable with respect to the anchor. In this case, the small chain 37 that joins the device assembly to the lower base of the anchor is fixed to the heel 45 provided at the seesawing piece 39, whilst the ring 38 that attaches the upper part of the anchor to the device is arranged and retained between both said parts or pieces 16 and 39.

Any of the three embodiments of the device are complemented with an independent accessory generally referred to with number 46, this being the one corresponding to that being shown in FIGS. 11, 12, 13, 14 and 15.

FIGS. 11 and 12 correspond to a way of embodiment of said cage-shaped accessory, whilst FIG. 13 correspond to a second way of embodiment thereof and FIGS. 14 and 15 to alternative ways of embodiment.

Concerning the way of embodiment corresponding to FIGS. 11 and 12, the said independent accessory 46 preferably comprises a series of rods 47 joined among them by means of annular rods 48, with the peculiarity that one of the longitudinal rods 47 extends by its lower part exceeding the length of the others in order to constitute some kind of projection 49 in way of a hook of especial configuration, i.e., without ends, since that kind of hook 49 is formed by both portions of bent rods that bend inwards and upwards without defining sharp ends, but a part to be adapted to the lower portion of the housing 3 and, specifically, for tractioning the disk piece 5, as it will be described hereinafter. Said accessory as shown in FIGS. 11 and 12 presents, in correspondence with the upper rod or ring 48 a radial appendix 50 which is attached to the end of a cable for tractioning the very accessory 46, such as it will also be described hereinafter.

The accessory or cage corresponding to the way of embodiment as shown in FIG. 13, is only formed by two longitudinal rods 47 that bend by their lower end into a curvilinear shape 51 and that are joined among them without break in continuity through a bent portion 52 inwardly projected, said portion 52 having the same function as the aforementioned hook-like 49 for the embodiment of FIGS. 11 and 12.

Between said two rods 47 corresponding to the accessory of FIG. 13, two turns 53 are welded, also being constituted by both rods, one of them in correspondence with the upper end and the other in correspondence with a part near the lower end, so that, through said turns 53, the suspension chain or cable of the device assembly and, consequently, of the anchor, can be inserted with no difficulty. On the upper turn 53 is welded a rigid ring 54 that is arranged according to a horizontal plane, so that, through said ring 54 the accessory 46 is attached to a cable that will be handled by the operative or user of the boat, i.e., that the ring 54 will accomplish the same function as the radial appendix 50 of the accessory corresponding to FIGS. 11 and 12. It has also been foreseen that the accessory of FIG. 13 is complemented with a rigidity semi-ring 55 being welded between both rods 47 and arranged between the lower turn 53 and the very lower part of the accessory, such as it can be clearly seen in FIG. 13.

FIG. 14 shows other alternative form of the tractioning accessory on description, which is also formed by two rods 47, the lower end of which is bent in order to define both lower portions tending to converge outwards and between which portions is welded a piece portion 59 having an especial configuration and disposition, said piece portion defining the hook-like structure 49 that has been mentioned in the three above figures. The turns or rings 60 are welded between said rods 47, in correspondence with the upper part and a zone near the lower part. Said rings 60 have a wide open portion wherein a band or the like 61 is fixed, which is deformed inwardly when pressed and enables the anchor suspension chain or cable to be inserted inside the accessory 46, not being able to come out of it, because the band 61 recovers its original position and shuts said opening of the corresponding ring 60.

FIG. 15 shows other alternative of said accessory 46, which is constituted in this case by the rods 47 with their lower end being bent, said ends tending to converge outwards and the piece 59 constituting the tractioning hook being welded between them, all that such as in FIG. 14, but with the variant that in said FIG. 15 the rings are divided into two halves, one of them 62 being fixed between the rods 47 and the other one 63 being hinged at 64 to one of the rods 47, thereby enabling the accessory to open side-ways for the insertion of the anchor suspension chain or cable, said anchor being retained when closing again the half 63 of said rings, each half 63 being provided at its free end with attaching means 65 in order to avoid the accidental opening thereof.

FIGS. 16 and 17 show schematically the operations to be carried out for releasing, by the device according to the invention, an anchor moored to the sea bottom, i.e., caught on a crack.

Such as it is shown in FIG. 16, an anchor 56 appears retained in a crack. In case said anchor 56 is tractioned in the classical way, i.e., by means of a suspension chain or cable directly attached thereto, it is impossible to release said anchor, since, when tractioning the upper part thereof, the corresponding lug located in the crack is more and more stuck into it.

Now then, with the device according to the invention, the release of said anchor 56 is easily carried out with no difficulty at all. In this sense, such as it has already been commented along the present specification, the described device will be inserted between the ring 38 provided at the upper end of the anchor 56 arm and the lower end of the suspension chain or cable 57. That is to say, that instead fixing directly the suspension chain or cable 57 to the ring 38 of the anchor 56, the very device according to the invention is inserted between said ring 38 of the anchor and the lower end of the suspension chain or cable 57.

Such as it has also been said along the present specification, between the device in question and the lower base of the anchor 56, i.e., the rear part of the attaching lugs thereof, is arranged the small chain 37, which, in the case of the embodiments of the device corresponding to FIGS. 1 to 4 and 5 to 7, is arranged between the lower base of the anchor as mentioned and the expansion 16 corresponding to the part generally referred to with number 1, whilst in the embodiment of FIGS. 8 to 10, said chain 37 is arranged between the very lower base of the anchor and the seesawing piece 39 and, specifically, fixed to the heel 45 of said piece.

On the other hand, the assembly of both parts constituting the device is carried out as previously described, i.e., positioning firstly the projection 28 of the part or piece 39 at the step 29 of the part or expansion 16, so that, once this engagement between said step and said projection has been made, the disk piece 5 is tractioned upwards and both said pieces 16 and 39 are adapted each other, the disk piece 5 being then released so that the lug 31 stays inside the very cylindrical body of said disk piece 5, both parts or pieces being thus retained in-between and the anchor 56 being thereby suspended from the very suspension chain or cable 57 with the insertion of the assembled device.

As it was being said, in order to proceed to releasing the anchor moored to the sea bottom or caught on a crack, such as it is shown in FIGS. 16 and 17, first of all the boat is made to advance from the position referred to with a in FIG. 16 to the position marked with b in the same FIG. 16. The accessory 46 constituting the cage-like structure is then slided along the suspension chain or cable 57, such as shown in said position b of FIG. 16. Said accessory 46 will be obviously attached to a cable 58 which will be fixed by its end, either to the appendix 50 of the accessory 46 corresponding to FIGS. 11 and 12 or to ring 54 of the accessory 46 corresponding to FIG. 13. In whichever case, said accessory 46 is slided such as said before along the suspension chain or cable 57 and, due to the especial configuration thereof and, of course, to the configuration of the device, the hook-like structure 49 of the accessory corresponding to FIGS. 11 and 12, or the lower portion 52 of the accessory corresponding to FIG. 13, or the piece 59 of the accessory corresponding to FIGS. 14 and 15, will be inserted over the lower part of the housing 3, such as shown for instance in FIGS. 3, 6 and 9, and, consequently, said hook 49 or in its case the lower part 56 or 59 of said cage or accessory 46 will lean against the lower face of the disk piece 5. In this way, if the cable 58 that lays hold of the accessory 46 is tractioned, said hook 49 or lower portion 52 or piece 59 thereof will traction said disk piece 5 upwards, opposite to the action of the spring 8, said disk piece 5 being thus displaced upwards and the lug 31 being consequently released, the piece constituting the general part referred to with number 2, in all embodiments, becoming free with respect to the part generally referred to with number 1, so that, in some cases, both pieces will become independent from each other and, in other case, specifically in the embodiment of FIGS. 8, 9 and 10, the part 2 of the device will seesaw with respect to the part 1, but in any case the ring 38 provided at the upper end of the anchor 56 arm will be released and, consequently, said anchor 56 will be attached to the device only through the small chain 37.

Once this release has been achieved such as shown in the positioning referred to with c in FIG. 17, the boat will be made to advance up to the position referred to with d in said FIG. 17, in order to traction then the suspension chain or cable 57, which, through the small chain 37, will traction the lower base of the anchor 56, which tractioning will be carried out in an almost opposite sense with respect to the direction of the attaching lug of said anchor, thereby releasing the latter, so as to raise finally all the assembly, the anchor included, on board of the boat.

I claim:

1. A system for releasing an anchor moored to the bottom of the sea, said system is attachable between the anchor and an anchor chain, and comprises:

a housing having a closed top end with a hole therein, an open bottom end, an inner wall surface;

a disk piece with a central hole, located within said housing, is axially displaceable within said housing;

a spring located between the inner wall surface and said disk piece so as to exert an axial force on said disk piece;

an axial bolt extending through said disk piece, said spring, said open bottom end and said hole in said closed top end so as to form a first part, said bolt has an upper end that extends out of said hole and has a transverse hole and a lower end that extends out the open bottom end of the housing;

an attachment means, attached to said transverse hole and said anchor chain so that said bolt remains attached to said housing;

a second part detachably connected to said bolt so that the first and second parts can be separated and the anchor released from its mooring, said second part has a lower portion that is connectable to the anchor and an upper portion having a pawl-like structure with an inclined inner edge that can engage a ramp on said bolt; and a small chain connectable to the first part and a lower portion of said anchor.

2. A system for releasing an anchor moored to the bottom of the sea, according to claim 1 wherein the lower end of the bolt has a forked shape, and has arms defining a first set of recesses and projections complementary to a second set of recesses and projections on said second part.

3. A system for releasing an anchor moored to the bottom of the sea, according to claim 2 wherein said pawl-like structure consists of a central piece, with the inclined inner edge, and at least one wing piece on either side of the central piece so as to form the second set of recesses and projections.

4. A system for releasing an anchor moored to the bottom of the sea, according to claim 3, wherein a top portion of said central piece is notched so as to engage a neck portion that extends from said disk, when said first and second parts are connected.

5. A system for releasing an anchor to the bottom of the sea, according to claim 4, wherein the neck portion abuts, when the first and second parts are connected, a flanged portion on the lower end of said bolt.

6. A system for releasing an anchor moored to the bottom of the sea, according to claim 5, wherein the projection on the lower end of the bolt is provided with a transversal step complementary to a tab at the corresponding recess on said second part, said complementary transverse step and tab constitute a means of initiation of the coupling between the first and second parts.

7. A system for releasing an anchor moored to the bottom of the sea, according to claim 6 wherein a lug extends from the lower end of the bolt and is connectable to the small chain.

8. A system for releasing an anchor moored to the bottom of the sea, according to claim 7, further comprising a cage-like structure formed by a plurality of upstanding structural members connected to at least one lateral member, said cage can surround and move along the anchor chain and has a connection portion connectable to a maneuvering cable, said cage also has a hook means that can be maneuvered underneath said housing so as to engage the disk piece and, upon pulling of the maneuvering cable, cause the disk piece to be displaced upwards so as to release the pawl-like piece and thereby separate the first part from the second part.

9. A system for releasing an anchor moored to the bottom of the sea, according to claim 1, further comprising a cage-like structure formed by a pluralilty of upstanding structural members connected to at least one lateral member, said cage can surround and move along the anchor chain and has a connection portion connectable to a maneuvering cable, said cage also has a hook means that can be maneuvered underneath said housing so as to engage the disk piece and, upon pulling of the maneuvering cable, cause the disk piece to be displaced upwards so as to release the pawl-like piece and thereby separate the first part from the second part.

10. A system for releasing an anchor moored to the bottom of the sea, according to claim 1, wherein the part constituting the pawl-like structure is formed by a projection from said second part.

11. A system for releasing an anchor moored to the bottom of the sea, according to claim 10, wherein the recesses and projections, through which the coupling between both parts of the device is carried out, are flat surfaces.

12. A system for releasing an anchor moored to the bottom of the sea, said system is attachable between the anchor and an anchor chain, and comprises:

a housing having a closed top end with a hole therein, an open bottom end, an inner wall surface;

a disk piece with a central hole, located within said housing, is axially displaceable within said housing;

a spring located between the inner wall surface and said disk piece so as to exert an axial force on said disk piece; an axial bolt extending through said disk piece, said spring, said open bottom end and said hole in said closed top end so as to form a first part, said bolt has an upper end that extends out of said hole and has a transverse hole and a lower end that extends out the open bottom end of the housing;

an attachment means, attached to said transverse hole and said anchor chain so that said bolt remains attached to said housing;

a second part pivotably connected to said bolt so that the first and second parts can be pivoted apart from one another and the anchor released from its mooring, said second part having a lower portion that is connectable to the anchor and an upper portion that is notched so as to engage a neck portion, extending from said disk, when said first part and said upper portion are connected; and a small chain connectable to the second part and a lower portion of said anchor.

13. A system for releasing an anchor moored to the bottom of the sea, according to claim 12, further comprising a cage-like structure formed by a plurality of upstanding structural members connected to at least one lateral member, said cage can surround and move along the anchor chain and has a connection portion connectable to a maneuvering cable, said cage also has a hook means that can be maneuvered underneath said housing so as to engage the disk piece and, upon pulling of the maneuvering cable, cause the disk piece to displaced upwards so as to release the pawl-like piece and thereby separate the first part from the second part.

14. A system for releasing an anchor moored to the bottom of the sea, according to claim 13 wherein lateral members are detachable from the cage-like structure so as to allow the anchor chain to be inserted into the cage-like structure.

* * * * *

UNITED STATES PATENT AND TRADEMARK OFFICE

CERTIFICATE OF CORRECTION

PATENT NO. : 4,846,093

DATED : July 11, 1989

INVENTOR(S) : Alfonso GARCIA NORENA

It is certified that error appears in the above-identified patent and that said Letters Patent is hereby corrected as shown below:

Title page, Item [19], column 1, line 2 -
Before "NORENA" insert -- GARCIA --

Item [76], line 1 -
Inventor's full name should be "Alfonso GARCIA NORENA"

Signed and Sealed this

Thirtieth Day of October, 1990

*Attest:*

HARRY F. MANBECK, JR.

*Attesting Officer*

*Commissioner of Patents and Trademarks*